US010665358B2

(12) United States Patent
Jeong et al.

(10) Patent No.: US 10,665,358 B2
(45) Date of Patent: May 26, 2020

(54) RADIOACTIVE WASTE CONTAINER

(71) Applicant: Korea Atomic Energy Research Institute, Daejeon (KR)

(72) Inventors: KwanSeong Jeong, Sejong-si (KR); Jea Hyun Ha, Daejeon (KR); Seung-Kook Park, Daejeon (KR); Bum Kyoung Seo, Daejeon (KR); Sang Bum Hong, Daejeon (KR)

(73) Assignee: KOREA ATOMIC ENERGY RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 16/136,096

(22) Filed: Sep. 19, 2018

(65) Prior Publication Data

US 2019/0304614 A1 Oct. 3, 2019

(30) Foreign Application Priority Data

Mar. 30, 2018 (KR) ..... 10-2018-0037647

(51) Int. Cl.
*G21F 5/005* (2006.01)
*G21F 5/12* (2006.01)

(52) U.S. Cl.
CPC ..... *G21F 5/005* (2013.01); *G21F 5/12* (2013.01); *G21Y 2002/302* (2013.01); *G21Y 2002/60* (2013.01); *G21Y 2004/30* (2013.01)

(58) Field of Classification Search
CPC . G21F 5/00; G21F 5/002; G21F 5/005; G21F 5/008; G21F 5/012; G21F 5/015; G21F 5/06
USPC ..... 250/506.1, 507.1
See application file for complete search history.

(56) References Cited

U.S. PATENT DOCUMENTS 4,698,510 A * 10/1987 Handke ..... G21F 5/002 250/506.1
4,862,007 A * 8/1989 Mallory ..... G21F 5/10 250/506.1
5,513,232 A * 4/1996 Jones ..... G21F 5/008 376/272
6,587,536 B1 7/2003 Singh et al.
2005/0154275 A1* 7/2005 Chinol ..... G21F 5/018 600/407

(Continued)

FOREIGN PATENT DOCUMENTS

JP 2001-337196 12/2001
JP 2003-004891 1/2003
JP 2004-037450 2/2004

(Continued)

OTHER PUBLICATIONS

Korean Patent Office, Office Action, issued in connection with Korean Patent Application No. 10-2018-0037647, dated Jun. 28, 2018, with English machine translation, 12 pages.

*Primary Examiner* — Jason L McCormack
(74) *Attorney, Agent, or Firm* — Hanley, Flight & Zimmerman, LLC

(57) ABSTRACT

A radioactive waste container, for storing and transporting a radioactive waste, includes a container body, a cover and a water drain unit. The cover is fastened to the container body. The water drain unit is provided at the container body without protruding to an outside of the container body and configured to selectively drain water in the container body.

14 Claims, 14 Drawing Sheets

(B - B)

(56) References Cited

U.S. PATENT DOCUMENTS

| | | | | |
|---|---|---|---|---|
| 2005/0224729 | A1* | 10/2005 | Tamaki | G21F 5/00<br>250/507.1 |
| 2009/0198092 | A1* | 8/2009 | Singh | G21F 5/10<br>588/16 |

FOREIGN PATENT DOCUMENTS

| | | |
|---|---|---|
| JP | 2004-093507 | 3/2004 |
| JP | 2004-125663 A | 4/2004 |
| JP | 2005-043058 | 2/2005 |
| JP | 2013-195091 | 9/2013 |
| JP | 2015-042988 | 3/2015 |

* cited by examiner ( A − A )

(A – A)

( B - B )

RADIOACTIVE WASTE CONTAINER

CROSS-REFERENCE TO RELATED APPLICATIONS

This application claims priority to and benefit of Korean Patent Application No. 10-2018-0037647, filed on Mar. 30, 2018, the disclosure of which is incorporated herein in its entirety by reference.

FIELD OF THE INVENTION

The present invention relates to a radioactive waste container.

BACKGROUND OF THE INVENTION

Generally, radioactive waste indicates material containing a concentration of radioactive nuclide at or above a specified level, or material contaminated with a radioactive nuclide.

According to subparagraph 18 of Article 2 of the Korean Nuclear Safety Act, radioactive waste is defined as "radioactive material or material contaminated with the radioactive material that should be disposed (including used nuclear fuel determined to be disposed according to subparagraph 35 of Article 4).

Radioactive waste is classified into high-level radioactive waste and intermediate/low-level radioactive waste depending on the radioactivity concentration and heat generation rate.

In subparagraph 1 of Article 2 of the Enforcement Decree of the Nuclear Safety Act, high-level radioactive waste is defined as radioactive waste having a radioactivity concentration and heat generation rate higher than those specified by the Nuclear Safety and Security Commission.

Further, in Article 2-1 of the Enforcement Decree of the Nuclear Safety Act, intermediate/low-level radioactive waste is defined as radioactive waste other than high-level radioactive waste.

According to Article 3 of the Nuclear Safety and Security Commission Notice (No. 2016-16), high-level radioactive waste and intermediate/low-level radioactive waste are classified based on a "radioactivity concentration of 4000 Bq/g of radionuclide emitting alpha-rays with a half-life of 20 years or more and heat generation rate of 2 $kW/m^3$".

Most of the radioactive waste is generated in a nuclear power generation process. For example, the radioactive waste is generated in mining, refining, conversion, enrichment, fuel fabrication of uranium, nuclear power operation, reprocessing, dismantling of nuclear power facilities, and the like.

Among those processes, the dismantling of nuclear power facilities indicates the process of dismantling nuclear power facilities of old nuclear power plants. This process includes a step of controlling access to main facilities after the decontamination of radioactive pollutants and the removal of the radioactive pollutants from the nuclear power facilities, and a step of dismantling and removing radioactive-contaminated facilities and structures in order to decrease the radioactivity level to a level in which a site can be used without limitation.

Recently, as the nuclear power plants in operation have grown older, the number of nuclear power plants at the end of their life span has increased. Therefore, there is a demand for a technique for processing the radioactive waste generated during the process of dismantling nuclear power facilities of nuclear power plants that have ceased operation. At this stage, a technique for dismantling and cutting nuclear power facilities is applied based on the characteristics of the particular nuclear power facility. For example, an underwater remote plasma arc technique is applied to various components of a reactor core, an underwater remote arc saw cutting technique is applied to a reactor pressure container, and a mechanical cutting technique and an abrasive water jet technique are applied to shielding concrete surrounding a nuclear reactor.

The radioactive waste generated at the radioactive waste generation site is stored in a container such as a special container, a drum, a large container, or the like, and then transported to a radioactive waste disposal site for isolated disposal. For example, the radioactive waste transported to the radioactive waste disposal site is isolated and disposed of in a surface disposal facility close to the ground surface or in a cave disposal facility underground by several tens of meters from the ground surface.

However, in the case of dismantling nuclear power facilities under water in order to improve radiation shielding efficiency, a radioactive waste container for storing the radioactive waste generated in the process of dismantling the nuclear power facilities should be positioned under water. Presently, it is considerably difficult to fasten a container body and a cover of the radioactive waste container under water.

Further, when a connecting portion, where the container body and the cover are made to be in contact with each other, is formed in a flat shape, there is a limit to how much the radiation emitted from the radioactive waste in the container body is shielded.

In addition, when storing the radioactive waste generated during the process of dismantling the nuclear power facilities under water, water flows into the container body positioned under water along with the radioactive waste. However, there is no device for draining the water flown into the container body. Therefore, the container body becomes excessively heavy and the radioactive waste storage efficiency is decreased.

Moreover, there is no device capable of lifting the radioactive waste container in which the radioactive waste is stored under water. Accordingly, it is not possible to stably lift the radioactive waste container in which the radioactive waste is stored under water and transport the radioactive waste container to the radioactive waste disposal site.

Patent Document

Korean Patent Publication No. 10-1604406 (Published on Mar. 11, 2016)

SUMMARY OF THE INVENTION

Embodiments of the present invention provide a radioactive waste container whose container body and cover can be easily fastened under water even when the radioactive waste container for storing a radioactive waste generated during the process of dismantling nuclear power facilities is positioned under water.

Further, the embodiments of the present invention provide a radioactive waste container capable of effectively shielding radiation generated from the radioactive waste stored in the container body by sealing the container body by fastening the cover to the container body.

Further, the embodiments of the present invention provide a radioactive waste container capable of preventing the radiation generated from the radioactive waste stored in the container body from leaking to the outside of the container body. This is due to the presence of one or more irregularities formed on the upper surface of the container body and accommodating portions formed on the bottom plate of the cover that is in contact with the upper surface of the container body, with the accommodating portions to be coupled to the irregularities of the container body.

Further, the embodiments of the present invention provide a radioactive waste container capable of selectively draining water that had flowed into the container body together with the radioactive waste during the process of storing the radioactive waste in the container body under water.

Further, the embodiments of the present invention provide a radioactive waste container that can be stably lifted up from water upon completion of the storage of radioactive waste under water and easily transported to a radioactive waste disposal site.

According to one aspect of the invention, there is provided a radioactive waste container. The radioactive waste container may include a container body, a cover fastened to the container body and a water drain unit provided at the container body without protruding to the outside of the container body and configured to selectively drain water in the container body.

Effect of the Invention

In accordance with the embodiments of the present invention, when the radioactive waste container for storing the radioactive waste generated in the process of dismantling the nuclear power facilities under water is positioned under water, the container body and the cover of the radioactive waste container can be easily fastened under water.

Further, in accordance with the embodiments of the present invention, the radiation generated from the radioactive waste stored in the container body can be effectively shielded by sealing the container body by fastening the cover to the container body.

Further, in accordance with the embodiments of the present invention, the radiation generated from the radioactive waste stored in the container body can be prevented from leaking to the outside of the container body due to the presence of one or more irregularities formed on the upper surface of the container body and the accommodating portions to be coupled to the irregularities, the accommodating portions being formed on the lower surface of the bottom plate of the cover that is in contact with the upper surface of the container body.

Further, in accordance with the embodiments of the present invention, it is possible to selectively drain water flown into the container body together with the radioactive waste during the process of storing the radioactive waste generated in the radioactive waste generation site, e.g., under water, in the container body under water.

Further, in accordance with the embodiments of the present invention, it is possible to safely lift the radioactive waste container from the water upon completion of the storage of the radioactive waste under water and easily transport the radioactive waste container to the radioactive waste disposal site.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Figure 1:
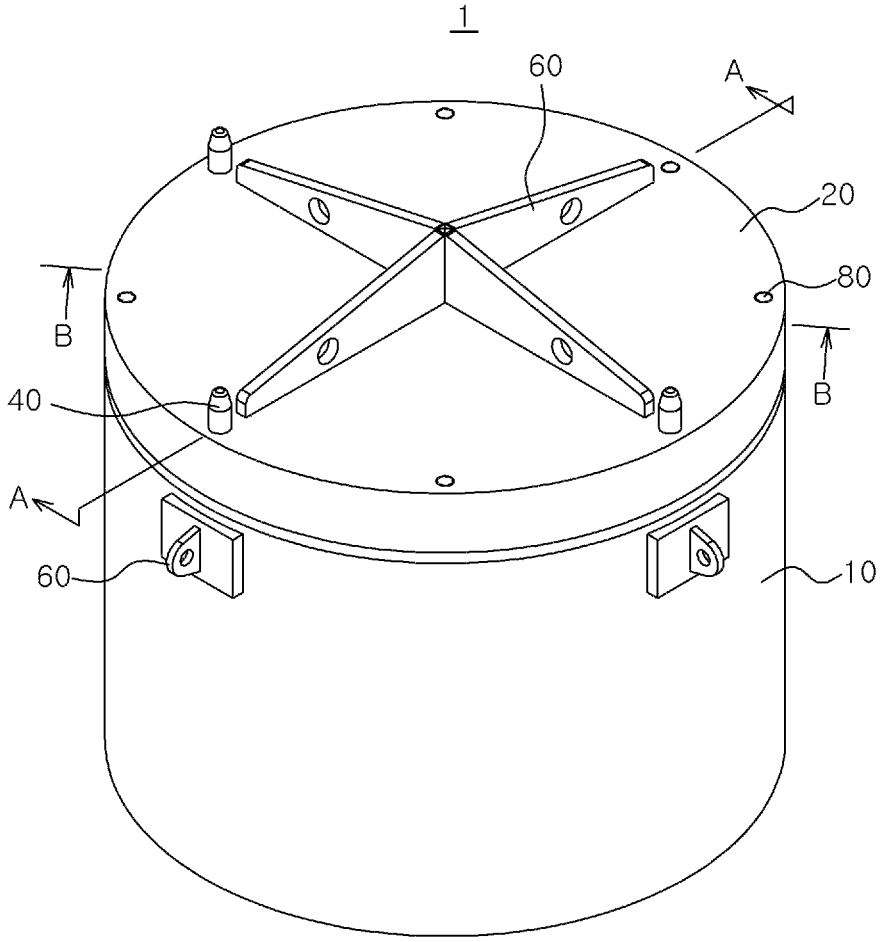
FIG. 1 is a perspective view showing a radioactive waste container according to an embodiment of the present invention.

Hereinafter, specific embodiments for implementing the technical idea of the present invention will be described in detail with reference to the accompanying drawings.

When it is judged that specific description on known configurations or functions related in the description of the present invention may unnecessarily obscure the essentials of the present invention, the detailed description will be omitted.

Further, when one element is described as being "connected" or "coupled" to the other element, it should be understood that one element may be directly connected or coupled to the other element, but a third element may be interposed between the two elements.

The terms used herein may be used to describe, and not to limit, various components. Singular terms include plural terms unless the context clearly indicates otherwise.

The directional terms used in this specification are applied to the embodiments illustrated in the drawings but may be differently expressed when a direction of a target is changed.

Figure 2:
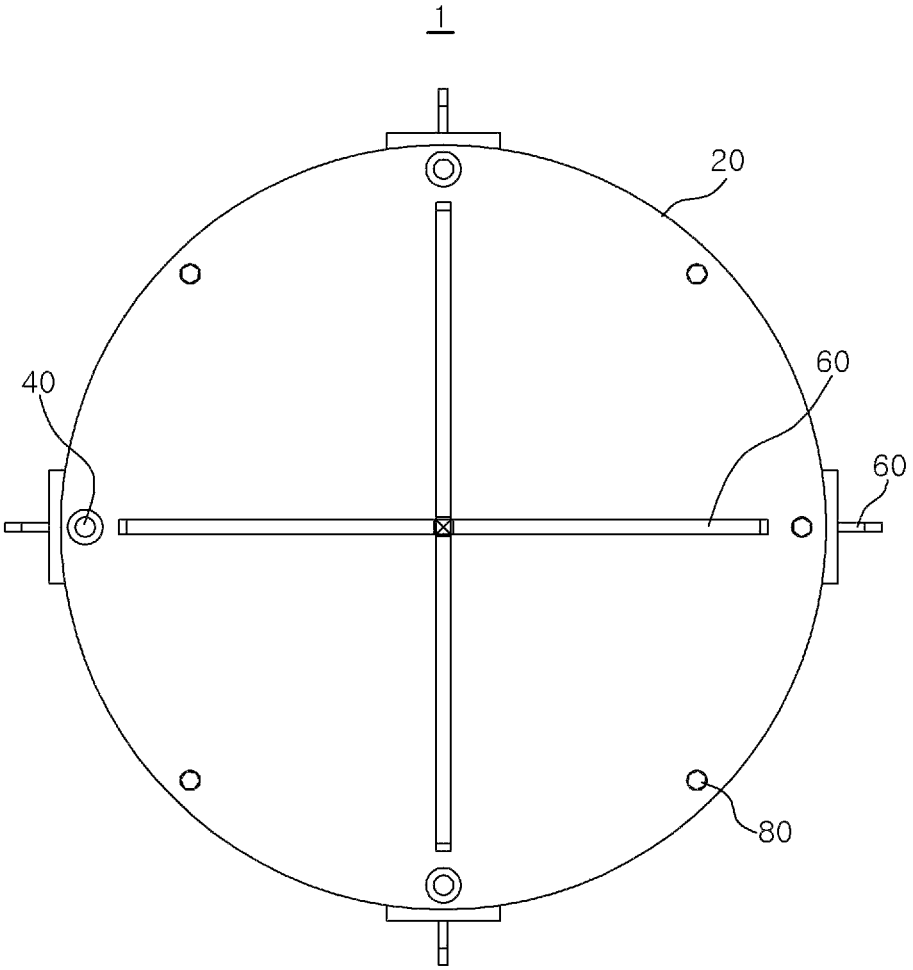
FIG. 2 is a plan view showing the radioactive waste container shown in FIG. 1.

Hereinafter, a radioactive waste container 1 according to an embodiment of the present invention will be described with reference to the accompanying drawings. FIG. 1 is a perspective view showing the radioactive waste container according to the embodiment of the present invention. FIG. 2 is a plan view showing the radioactive waste material shown in FIG. 1.

Referring to FIGS. 1 and 2, a radioactive waste container 1 according to an embodiment of the present invention can store a radioactive waste generated at a radioactive waste generation site and safely transport the radioactive waste to a radioactive waste disposal site while effectively shielding radiation generated from the radioactive waste stored therein.

In the present embodiment, the case in which the radioactive waste container 1 is positioned under water because the radioactive waste is generated under water by dismantling nuclear power facilities under water remotely will be described as an example. However, the technical idea of the present invention is not limited thereto. The radioactive waste may be generated at various sites, and the radioactive waste container 1 may be provided at various positions in response to the location of the radioactive waste generation site.

Figure 3:
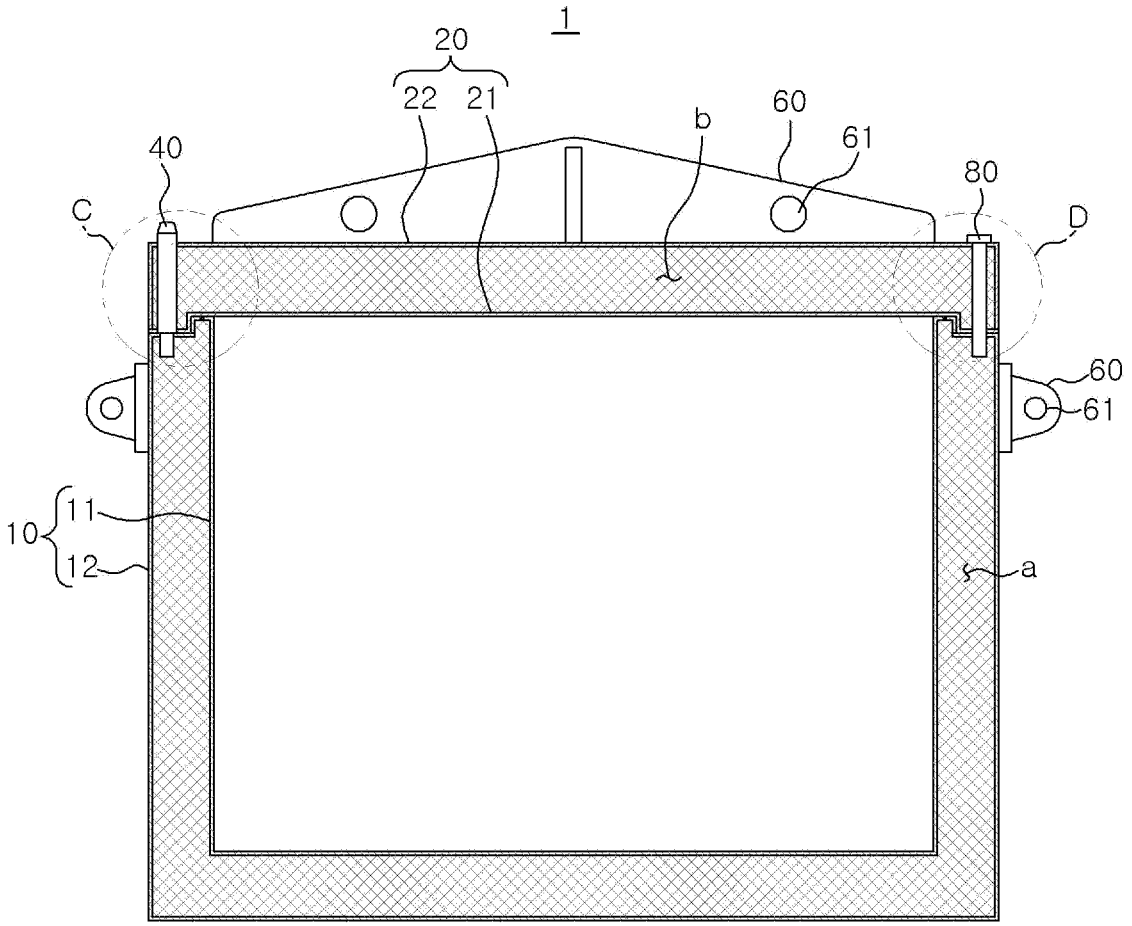
FIG. 3 is a cross sectional view taken along line A-A of FIG. 1.
Figure 4:
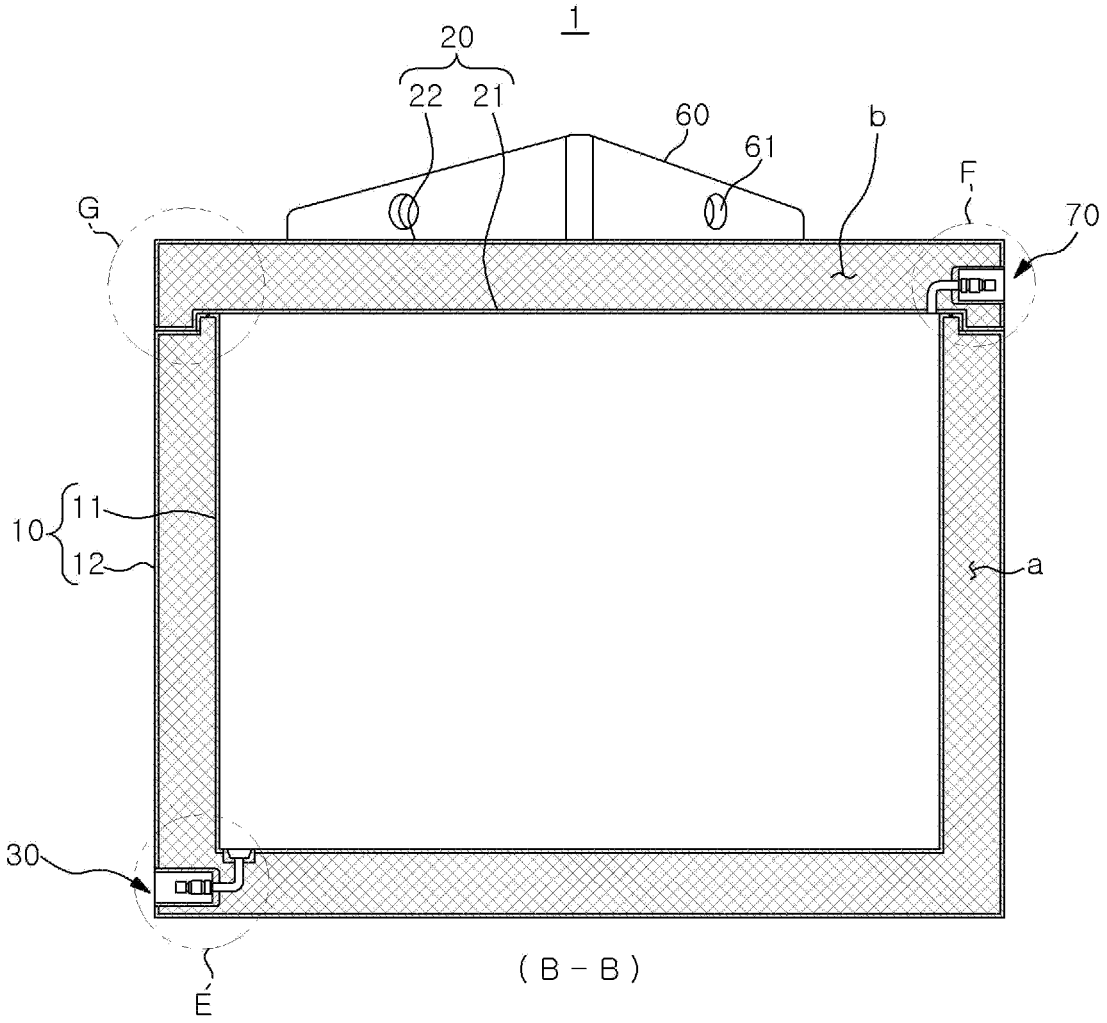
FIG. 4 is a cross sectional view taken along line B-B of FIG. 1.
Figure 5:
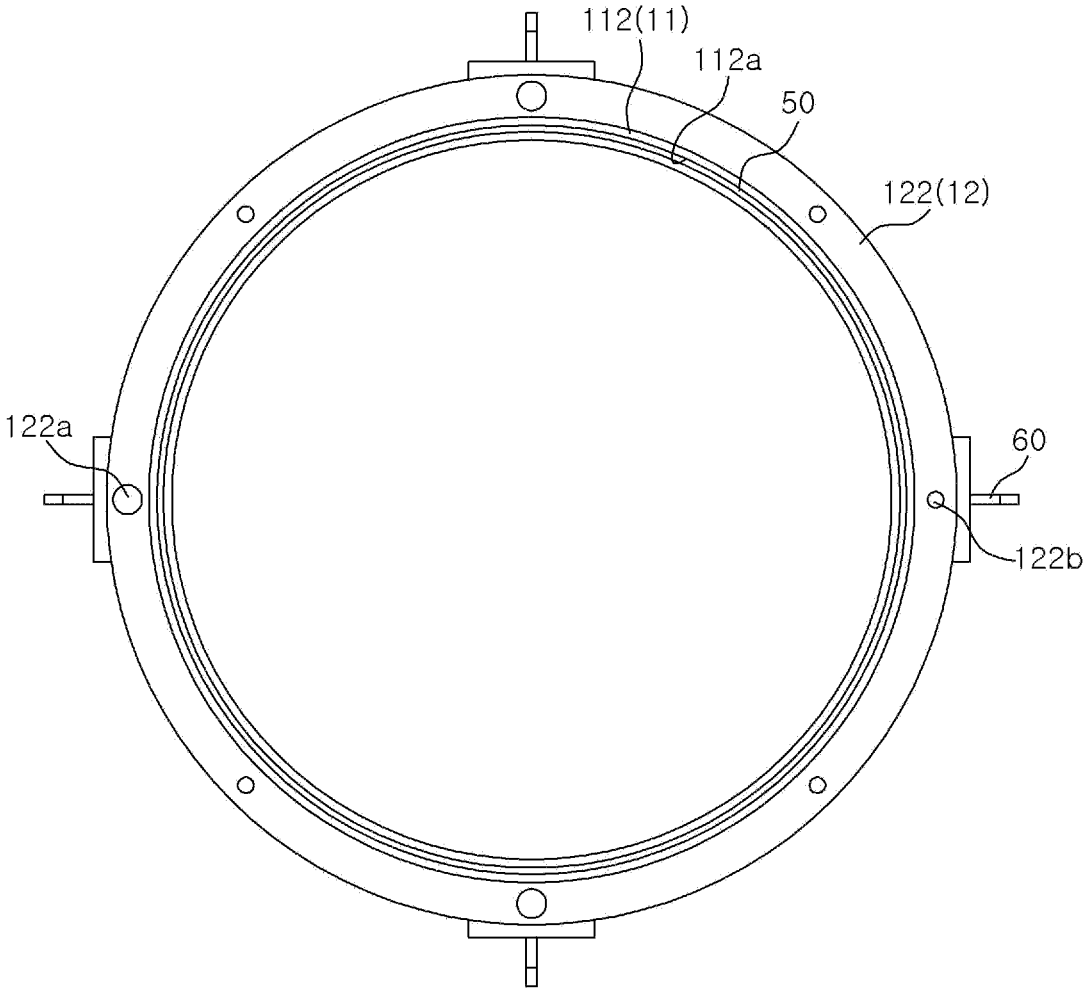
FIG. 5 is a plan view showing a container body of the radioactive waste container shown in FIG. 1.
Figure 6:
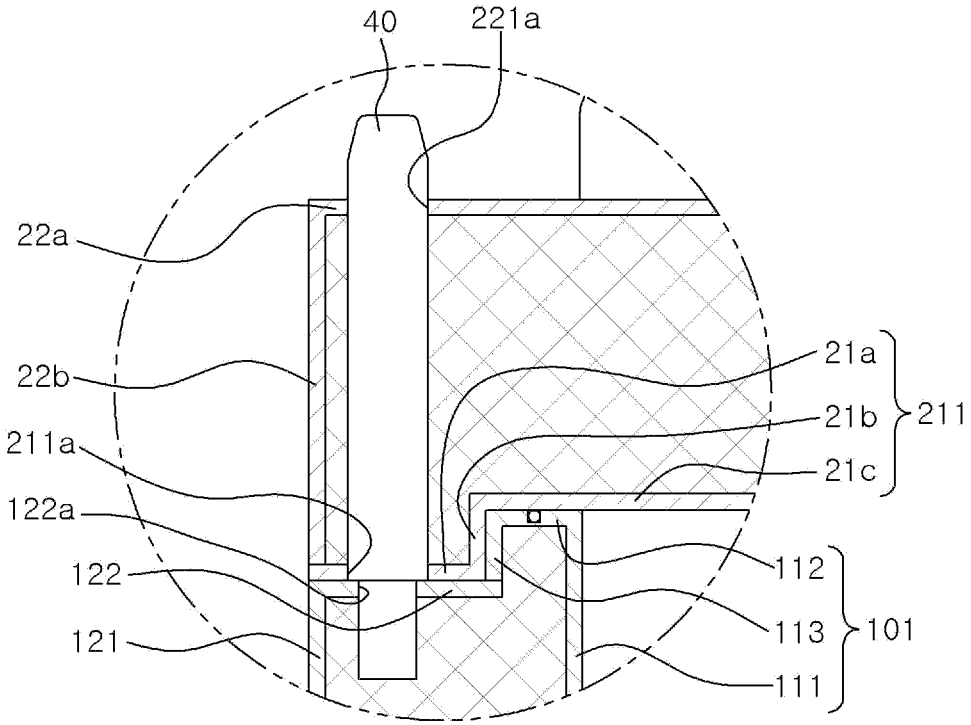
FIG. 6 is an enlarged view showing portion C of FIG. 3.
Figure 7:
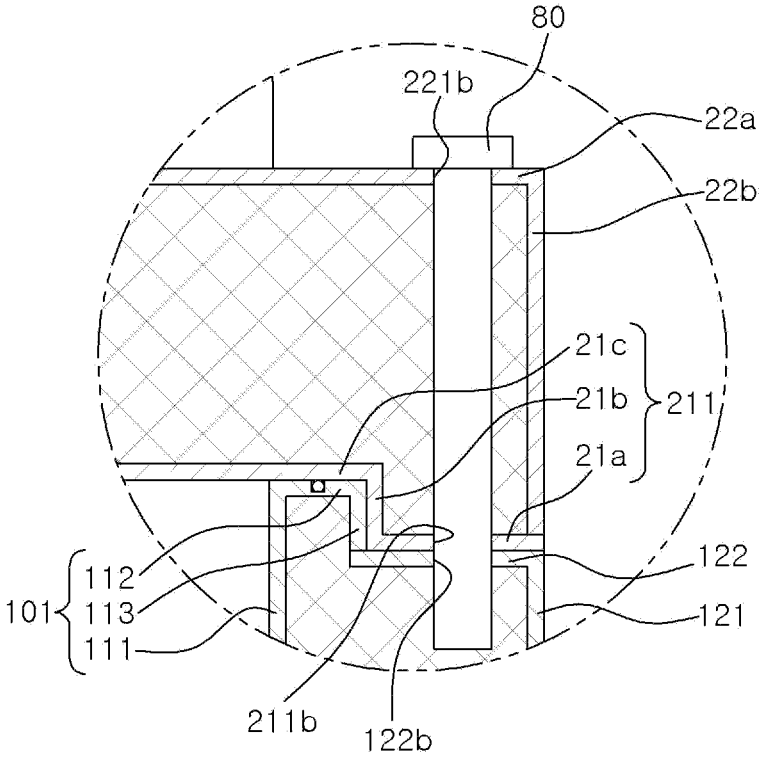
FIG. 7 is an enlarged view showing portion D of FIG. 3.
Figure 8:
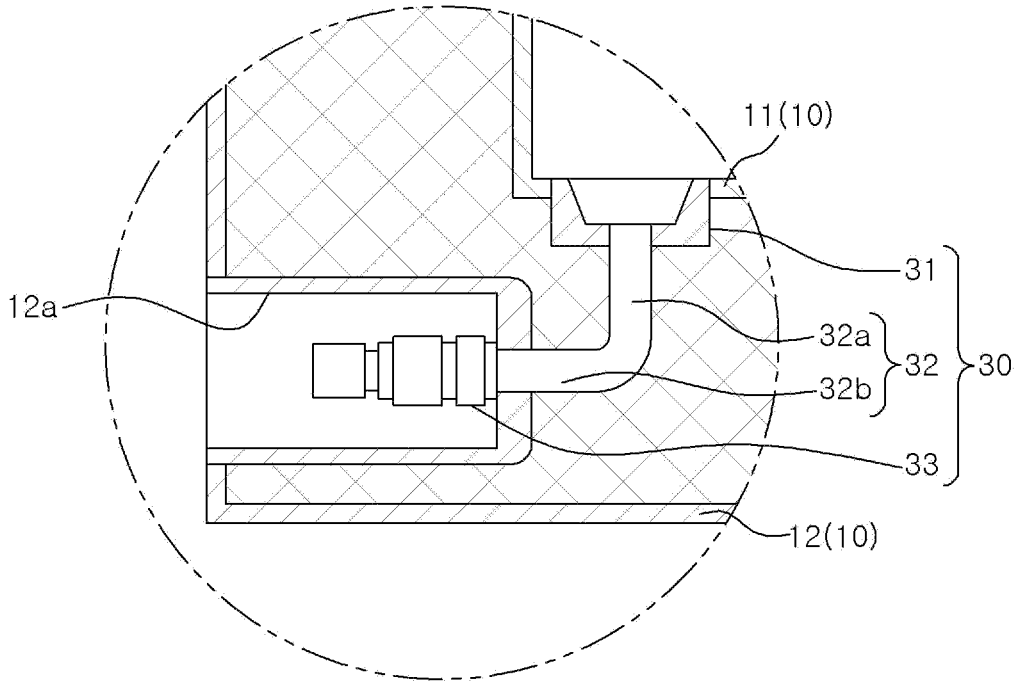
FIG. 8 is an enlarged view showing portion E of FIG. 4.
Figure 9:
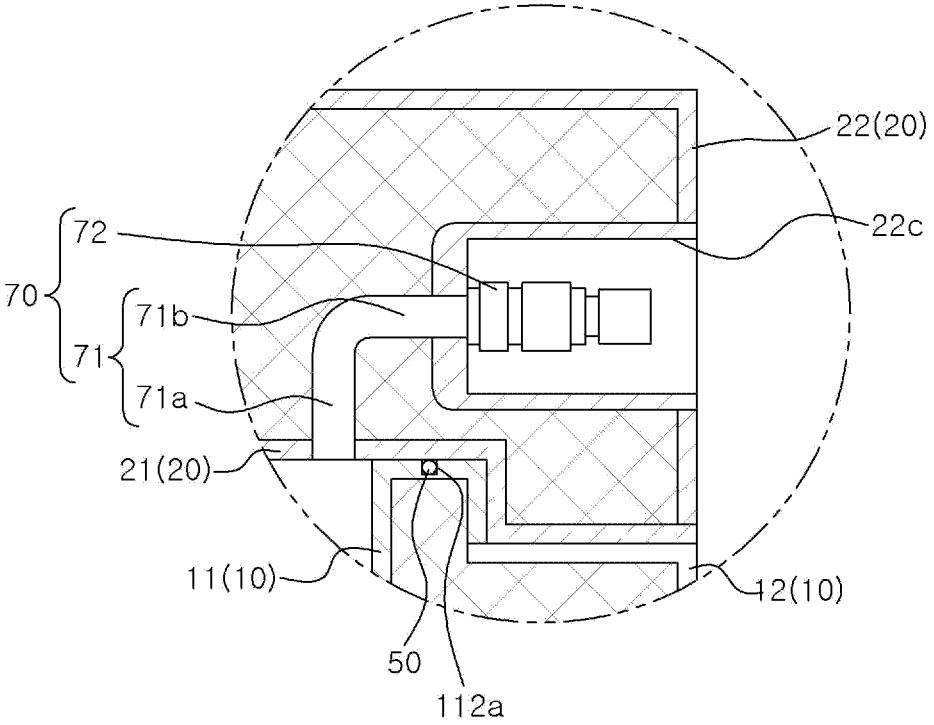
FIG. 9 is an enlarged view showing portion F of FIG. 4.
Figure 10:
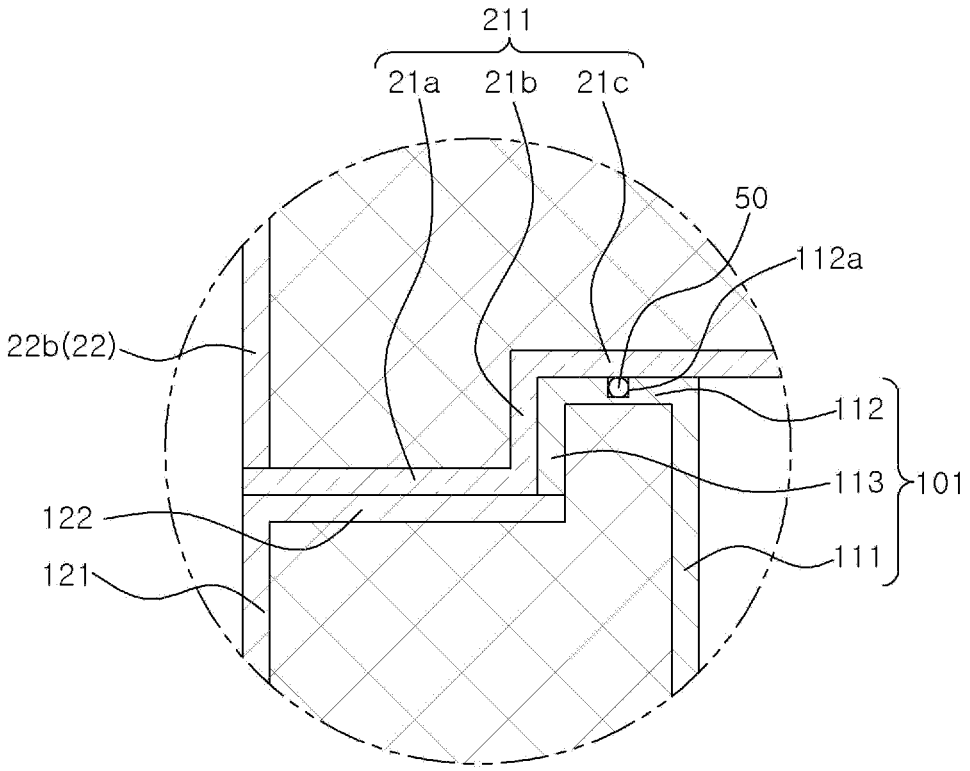
FIG. 10 is an enlarged view showing portion G of FIG. 4.

FIG. 3 is a cross sectional view taken along line A-A of FIG. 1. FIG. 4 is a cross sectional view taken along line B-B of FIG. 1. FIG. 5 is a plan view showing a container body of the radioactive waste container shown in FIG. 1. FIG. 6 is an enlarged view showing portion C of FIG. 3. FIG. 7 is an enlarged view showing portion D of FIG. 3. FIG. 8 is an enlarged view showing portion E of FIG. 4. FIG. 9 is an enlarged view showing portion F of FIG. 4. FIG. 10 is an enlarged view showing portion G of FIG. 4.

Referring to FIGS. 3 to 10, the radioactive waste container 1 according to the embodiment of the present invention may include a container body 10, a cover 20, a water drain unit 30, guide pins 40, a gasket 50, lifting lugs 60, an air supply unit 70, and bolts 80.

The container body 10 can provide a space (hereinafter referred to as "radioactive waste storage space") where the radioactive waste can be stored. Further, the container body 10 can shield radiation generated from the radioactive waste stored in the radioactive waste storage space. Here, "the radioactive waste" may be a dismantled waste, e.g., an intermediate/low-level radioactive waste, generated in the process of dismantling nuclear power facilities in a radioactive waste generation site, e.g., under water.

The container body 10 may be provided in the radioactive waste generation site, e.g., under water, where the nuclear power facilities are dismantled. However, this is merely an example, and the technical idea of the present invention is not limited thereto. For example, the position of the container body 10 may be different depending on the radioactive waste generation site, i.e., the place where the nuclear power facilities are dismantled.

The container body 10 may include an inner body 11 and an outer body 12 surrounding the inner body 11.

The inner body 11 in which the radioactive waste is substantially stored may be made of metal, e.g., stainless steel or the like.

The inner body 11 may include a main surface portion 111 forming the radioactive waste storage space having an open top, an extended portion 112 extending from an end portion of the main surface portion 111 in a direction toward a radially outer side of the inner body 11, and an inner body side coupling portion 113 bent downward from the extended portion 112 and coupled to the outer body 12. Here, "radially outer side of the inner body 11" indicates a direction from the center of the inner body 11 toward the peripheral surface of the inner body 11, and "radially inner side of the inner body 11" indicates a direction from the peripheral surface of the inner body 11 toward the center of the inner body 11. In the present embodiment, the inner body 11 and the outer body 12 are coupled to each other by, e.g., welding. However, it is not necessary to weld the inner body 11 and the outer body 12. The container body 10 may be formed as a single body. The terms "extended portion 112", "inner body side coupling portion 113" and "outer body side coupling portion 122," to be described later, are used to describe the container body 10 in detail.

A gasket insertion groove 112*a* may be formed on, e.g., the extended portion 112 of the inner body 11. The gasket insertion groove 112*a* may be recessed from one surface of the extended portion 112. A gasket 50 for firmly fastening the container body 10 and the cover 20 can be inserted into the gasket insertion groove 112*a*. The gasket 50 may be made of rubber or metal (e.g., copper (Cu)). In FIGS. 6, 9 and 10, the entire gasket 50 is inserted into the gasket insertion groove 112*a*. However, this is merely an example. For another example, at least a part of the gasket 50 may be inserted into the gasket insertion groove 112.

The outer body 12 can surround the inner body 11. Accordingly, a first hollow portion a can be formed between the outer body 12 and the inner body 11. A radiation shielding material can be provided in the first hollow portion a. For example, the radiation shielding material may include lead (Pb).

The outer body 12 may include a cover portion 121 facing the main surface portion 111 of the inner body 11 at the outside of the inner body 11, and the outer body side coupling portion 122 extended from the upper end portion of the cover portion 121 toward the radially inner side of the outer body 12 and coupled to the inner body side coupling portion 113 of the inner body 11. For example, the outer body 12 may be made of substantially the same material as that of the inner body 11. The outer body 12 may be made of, e.g., stainless steel. Here, "the radially inner side of the outer body 12" indicates the direction from the peripheral surface of the outer body 12 toward the center of the outer body 12, and "the radially outer side of the outer body 12" indicates the direction from the center of the outer body 12 toward the peripheral surface of the outer body 12.

Further, two or more guide pin insertion holes 122*a* are formed on the upper surface of the outer body 12, i.e., at the outer body side coupling portion 122 of the outer body 12, along a circumferential direction of the outer body 12. The guide pins 40 can be inserted into the guide pin insertion holes 122*a*. The initial position of the cover 20 with respect to the container body 10 can be determined by the guide pins 40 inserted into the guide pin insertion holes 122*a* before the container body 10 and the cover 20 are fastened.

When the nuclear power facilities are dismantled under water, the container body 10 should be positioned under water. The operation of accommodating the waste dismantled to an appropriate size in the container body 10 is remotely performed by a robot or the like. At this time, by the guide pins 40 inserted into the guide pin insertion holes 122*a*, an initial fixing of the cover 20 to the container body 10 can be easily performed and, then, the subsequent fastening of the cover 20 to the container body 10 can be easily performed. For example, the bolts 80 can be easily inserted into the bolt insertion holes 91*b*.

Two or more bolt insertion holes 122*b* may be formed on the upper surface of the outer body 12 and may be arranged along the circumferential direction of the outer body 12. The bolts 80 for fastening the container body 10 and the cover 20 can be inserted into the bolt insertion holes 122*b*.

By inserting the guide pins 40 into the guide pin insertion holes 122*a*, the position of the cover 20 with respect to the container body 10 can be secured, and the preliminary fixing between the container body 10 and the cover 20 can be performed. Then, by inserting the bolts 80 into the bolt insertion holes 122*b*, the cover 20 can be more firmly fixed to the container body 10. Accordingly, the radioactive waste storage space can be sealed from the outside. Therefore, in the present embodiment, three guide pins 40 and five bolts 80 are used. Although the case in which three guide pins 40 and three bolts 80 are alternately arranged has been described as an example, the number or the arrangement of the guide pins 40 and the bolts 80 may vary.

The container body 10 can be sealed by fastening the cover 20 to the container body 10. The cover 20 may include a bottom plate 21 to be in contact with an upper surface of the container body 10, and a top plate 22. A second hollow portion b may be formed between the bottom plate 21 and the top plate 22.

The bottom plate 21 can cover the open top of the inner body 11 while being in contact with the upper surface of the container body 10, i.e., the extended portion 112, the inner body side coupling portion 113, and the outer body side coupling portion 122 of the outer body 12.

The bottom plate 21 may include a first engaging portion 21*a* to be engaged with the outer body side coupling portion 122 of the outer body 12, a second engaging portion 21*b* protruded from an end portion of the first engaging portion 21*a* toward the top plate 22 and engaged with the inner body side coupling portion 113 of the inner body 11, and a cover portion 21*c* covering the open top of the inner body 11.

Guide pin insertion holes 211*a* into which the guide pins 40 can be inserted and bolt insertion holes 211*b* into which the bolts 80 can be inserted may be formed at the first engaging portion 21*a*.

The top plate 22 may have a facing portion 22*a* facing the cover portion 21*c* of the bottom plate 21, and a bottom plate side coupling portion 22*b* bent from an end portion of the facing portion 22*a* toward the bottom plate 21 and engaged with the first engaging portion 21*a* of the bottom plate 21. The bottom plate 21 of the cover 20 and the top plate 22 can be fastened by, e.g., welding. However, it is not necessary to weld the bottom plate 21 and the top plate 22. For example, the cover 20 may be formed as a single body. The terms "bottom plate side coupling portion 22*b*", "first engaging portion 21*a*" and the like are used to describe the cover 20 in detail.

The guide pin insertion holes 221*a* into which the guide pins 40 can be inserted and the bolt insertion holes 221*b* into which the bolts 80 can be inserted may be formed at the facing portion 22*a*.

A radiation shielding material, e.g., Pb, can be inserted into the second hollow portion b formed between the bottom plate 21 and the top plate 22.

One or more irregularities 101 may be formed on the upper surface of the container body 10, and the accommodating portions 211 to be coupled to the irregularities 101 of the container body 10 may be formed on a lower surface of the bottom plate 21 which will be in contact with the upper surface of the container body 10. At this time, the extended portion 112, the inner body side coupling portion 113, and the outer body side coupling portion 122 may form the irregularity in a single step shape on the supper surface of the container body 10. The accommodating portions 211, each including the cover portion 21*c*, the second engaging portion 21*b* and the first engaging portion 21*a*, may be formed on the bottom plate 21 of the cover 20 to correspond to the irregularities 101.

The irregularities 101 can be formed in a multi-step shape, for example, and the accommodating portions 211 can be formed in a multi-step shape to correspond thereto. The accommodating portions 211 may be capable of being coupled to the irregularities 101. Accordingly, the contact area between the upper surface of the container body 10 and the lower surface of the bottom plate 21 can be increased, and the radioactive waste storage space in the container body 10 can be more reliably sealed from an outside of the container body 10.

The following is brief description on the reason why one or more irregularities 101 are formed on the upper surface of the container body 10 and the accommodating portions 211 to be coupled to the irregularities 101 of the container body 10 are formed on the bottom surface of the bottom plate 21 which will be in contact with the upper surface of the container body 10. When the connecting portion where the container body 10 and the cover 20 are made to be in contact with each other, i.e., the upper surface of the container body 10 and the lower surface of the bottom plate 21, are formed in an uneven shape, a movement of radiation is hindered by the shape of the connecting portion, compared to when the connecting portion where the container body 10 and the cover 20 are made to be in contact with each other is formed in a flat shape. Because the radiation generated from the radioactive waste stored in the container body 10 is generally moved linearly. Therefore, the radiation generated from the radioactive waste stored in the container body 10 can be prevented from leaking to the outside of the container body 10 by the shape of the connecting portion.

Further, when the connecting portion where the container body 10 and the cover 20 are made to be in contact with each other, i.e., the upper surface of the container body 10 and the lower surface of the bottom plate 21, are formed in an uneven shape, the contact area between the upper surface of the container body 10 and the lower surface of the bottom plate 21 is increased, compared to when the connecting portion where the container body 10 and the cover 20 are made to be in contact with each other is formed in a flat shape. Therefore, the container body 10 and the cover 20 can be airtightly fastened.

In the present embodiment, the case in which one or more irregularities 101 are formed on the upper surface of the container body 10 and the accommodating portions 211 corresponding to the irregularities 101 are formed on the lower surface of the bottom plate 21 which will be in contact with the upper surface of the container body 10 has been described as an example. However, this is merely an example, and the technical idea of the present invention is not limited thereto. For example, one or more bent portions may be formed on the upper surface of the container body 10 and an accommodating portions corresponding to the bent portions of the container body 10 may be formed on the lower surface of the bottom plate 21 which will be in contact with the upper surface of the container body 10.

The water drain unit 30 can selectively drain water flown into the container body 10 during the process of storing the radioactive waste in the container body 10 to the outside of the container body 10. The water drain unit 30 may be provided at the container body 10 without protruding to the outside of the container body 10. This is because if the water drain unit 30 protrudes to the outside of the container body 10, the water drain unit 30 may be damaged when the radioactive waste container 1 is transported or when the radioactive waste is stored in the radioactive waste container 1.

Therefore, the water drain unit 30 may include a water drain pipe 32 extending from an inner bottom surface of the container body 10 to the outside of the container body 10. At this time, the outer side end portion of the water drain pipe 32 may be positioned inside the outer body 12 without protruding from the container body 10. Further, the opening and closing of the water drain pipe 32 can be controlled and, thus, the water in the container body 10 can be selectively drained to the outside of the container body 10.

More specifically, the water drain unit 30 may further include a water drain cup 31 formed in the inner body 11 being recessed from a bottom surface of the inner body 11 of the container body 10, and a water drain coupler 33 provided at an end portion of the water drain pipe 32, e.g., an end portion at a radially outer side of the container body 10. Here, "radially outer side of the container body 10" indicates a direction from a center of the container body 10 toward a peripheral surface of the container body 10, and "radially inner side of the container body 10" indicates a direction from the peripheral surface of the container body 10 toward the center of the container body 10.

The inner surface of the water drain cup 31 may be an inclined surface having a predetermined inclination angle. The water in the container body 10 can be moved more smoothly toward the water drain pipe 32 via the water drain cup 31 along the inclined surface of the water drain cup 31.

The water drain pipe 32 may be connected to the water drain cup 31. The water drain pipe 32 may be extended to the bottom surface of the outer body 12 and bent in a direction toward the radially outer side of the container body 10. Specifically, the water drain pipe 32 may include a first extended portion 32*a* extending from the bottom surface of the inner body 11 toward the bottom surface of the outer body 12, and a second extended portion 32*b* extending from an end portion of the first extension portion 32*a* toward the radially outer side of the inner body 11.

The water drain coupler 33 can be positioned inside a first recessed groove 12*a* formed in the outer body 12, the groove being recessed from the outer surface of the outer body 12 toward the radially inner side of the container body 10. The water drain coupler 33 is positioned inside the first recessed groove 12*a* and thus does not protrude to the outside of the outer body 12. Accordingly, the water drain coupler 33 is not damaged during the process of lifting the radioactive waste container 1 from water or transporting the lifted radioactive waste container 1 to the radioactive waste disposal site.

The water drain coupler 33 can be provided at an end portion of the second extension part 32*b* of the water drain pipe 32, and water in the container body 10 can be drained through the water drain pipe 32 to the outside of the container body 10. For example, the water drain coupler 33 may include a socket and a plug connected to the socket, or may be a valve. In that case, the water drain coupler 33 may include an in-line valve while considering that the water drain coupler 33 is positioned inside the first recessed groove 12*a*.

The initial position of the cover 20 with respect to the container body 10 can be determined by the guide pins 40 before the container body 10 and the cover 20 are fastened. Since the container body 10 and the cover 20 can be fastened in a state where the cover 20 is primarily fixed to the container body 10 by the guide pins 40, the container body 10 and the cover 20 can be easily fastened even under water.

By inserting the guide pins 40 into the guide pin insertion holes 221*a* and 211*a* formed in the cover 20 and the guide pin insertion holes 122*a* formed in the container body 10, the initial position of the cover 20 with respect to the container body 10 can be determined and the cover 20 can be primarily fixed to the container body 10.

The gasket 50 can firmly fasten the container body 10 and the cover 20. The gasket 50 can be inserted into the gasket insertion groove 112*a* formed on the upper surface of the container body 10. For example, the gasket 50 in the gasket insertion groove 112*a* is pressed by the cover 20 fastened to the container body 10, thereby sealing a gap between the container body 10 and the cover 20.

The gasket insertion groove 112*a* is positioned at the radially inner side of the container body 10, compared to the guide pin insertion holes 122*a* into which the guide pins 40 can be inserted and the bolt insertion holes 122*b* into which the bolts 80 can be inserted. Accordingly, the gasket 50 can also be positioned at the radially inner side of the container body 10, compared to the guide pins 40 and the bolts 80. The gasket 50 may be made of metal, e.g., copper (Cu).

At least one of the container body 10 and the cover 20 may be provided with the lifting lugs 60 to stably transport the radioactive waste container 1. For example, the lifting lugs 60 can be provided on at least one of the outer surface of the outer body 12 and the upper surface of the top plate 22.

The lifting lugs 60 may be provided with engaging holes 61 that can be connected to a lifting apparatus (not shown) for lifting the radioactive waste container 1 from water. In the present embodiment, the case in which four lifting lugs 60 are provided on the upper surface of the cover 20 and four lifting lugs 60 are provided on the outer body 12 of the container body 10 has been described as an example. However, this is merely an example, and the number of the lifting lugs 60 may vary.

Referring to FIG. 9, the air supply unit 70 can selectively supply air into the container body 10 to promote drainage of water stored in the container body 10 to the outside of the container body 10 through the water drain unit 30. The air supply unit 70 may be provided at the cover 20 without protruding to the outside of the cover 20.

The air supply unit 70 may include an air supply pipe 71 and an air supply coupler 72 provided at an end portion of the air supply pipe 71. The air supply pipe 71 has an extended portion 71*a* extending toward the top plate 22 while being connected to the bottom plate 21, and a bent portion 71*b* bent from an end portion of the extended portion 71*a* toward the radially outer side of the cover 20. Here, "radially outer side of the cover 20" indicates a direction from a center of the cover 20 to a peripheral surface of the cover 20, and "radially inner side of the cover 20" indicates a direction from the peripheral surface of the cover 20 toward the center of the cover 20.

The air supply coupler 72 can be positioned inside the second recessed groove 22*c* formed in the top plate 22, the groove being recessed from the outer surface of the top plate 22 toward the radially inner side of the cover 20. Since the air supply coupler 72 is positioned inside the second recessed groove 22*c* without protruding to the outside of the top plate 22, the air supply coupler 72 is not damaged when the radioactive waste container 1 is lifted from water or transported to the radioactive waste disposal site.

Another air supply device (not shown) may be connected to the air supply coupler 72 to supply air into the container body 10 through the air supply pipe 71. The air supply coupler 72 may be, e.g., a valve or the like, in particular an in-line valve. The air supplied into the container body 10 may push water flown into the container body 10 to the outside of the container body 10. Accordingly, the water in the container body 10 can be efficiently drained to the outside of the container body 10 through the water drain pipe 32 of the water drain unit 30.

Referring to FIG. 7, the bolts 80 can fasten and fix the container body 10 and the cover 20 which have been primarily coupled by the guide pins 40. Two or more bolts 80 may be inserted into the bolt insertion holes 221*b* and 211*b* formed in the cover 20 and then into the bolt insertion holes 122*b* formed in the container body 10.

The following is description on a method of storing a radioactive waste generated in a radioactive waste generation site in the radioactive waste container 1 configured as described above and transporting the stored radioactive waste to a radioactive waste disposal site.

In the case of dismantling nuclear power facilities under water where the radiation can be efficiently shielded, the container body 10 for storing the radioactive waste generated in the process of dismantling the nuclear power facilities can be positioned under water.

Next, the radioactive waste can be stored in the container body 10 positioned under water. When the storage of the radioactive waste in the container body 10 is completed, the container body 10 can be sealed by fastening the cover 20 to the top of the container body 10.

When the fastening of the container body 10 and the cover 20 is completed, a lifting apparatus (not shown) is connected to the lifting lugs 60 provided at at least one of the container body 10 and the cover 20 and, then, the radioactive waste container 1 can be lifted from water by driving the lifting apparatus.

Next, in order to more easily transport the lifted radioactive waste container 1 to the radioactive waste disposal site, water flown into the container body 10 can be drained to the outside of the container body 10 by connecting a water drain device (not shown) such as a water drain pump to the water drain unit and driving the water drain device before the radioactive waste container 1 is transported to the radioactive waste disposal site. At this time, in order to improve the drain efficiency in the process of draining water in the container body 10, an air supply device (not shown) such as an air pump is connected to the air supply unit 70 and driven. Accordingly, air is supplied into the container body 10, and the drainage of the water can be promoted.

Therefore, the water in the container body 10 is efficiently drained to the outside of the container body 10 via the water drain unit 30, and the radioactive waste container 1 lighter in weight than before the drainage of the water in the container body 10 to the outside of the container body 10 can be safely transported the radioactive waste disposal site.

In the present embodiment, the case in which the water in the container body 10 is drained to the outside of the container body 10 before the radioactive waste container 1 is transported to the radioactive waste disposal site has been described as an example. However, this is merely an example, and the technical idea of the present invention is not limited thereto. The timing of draining water in the container body 10 to the outside of the container body 10 may vary.

Figure 11:
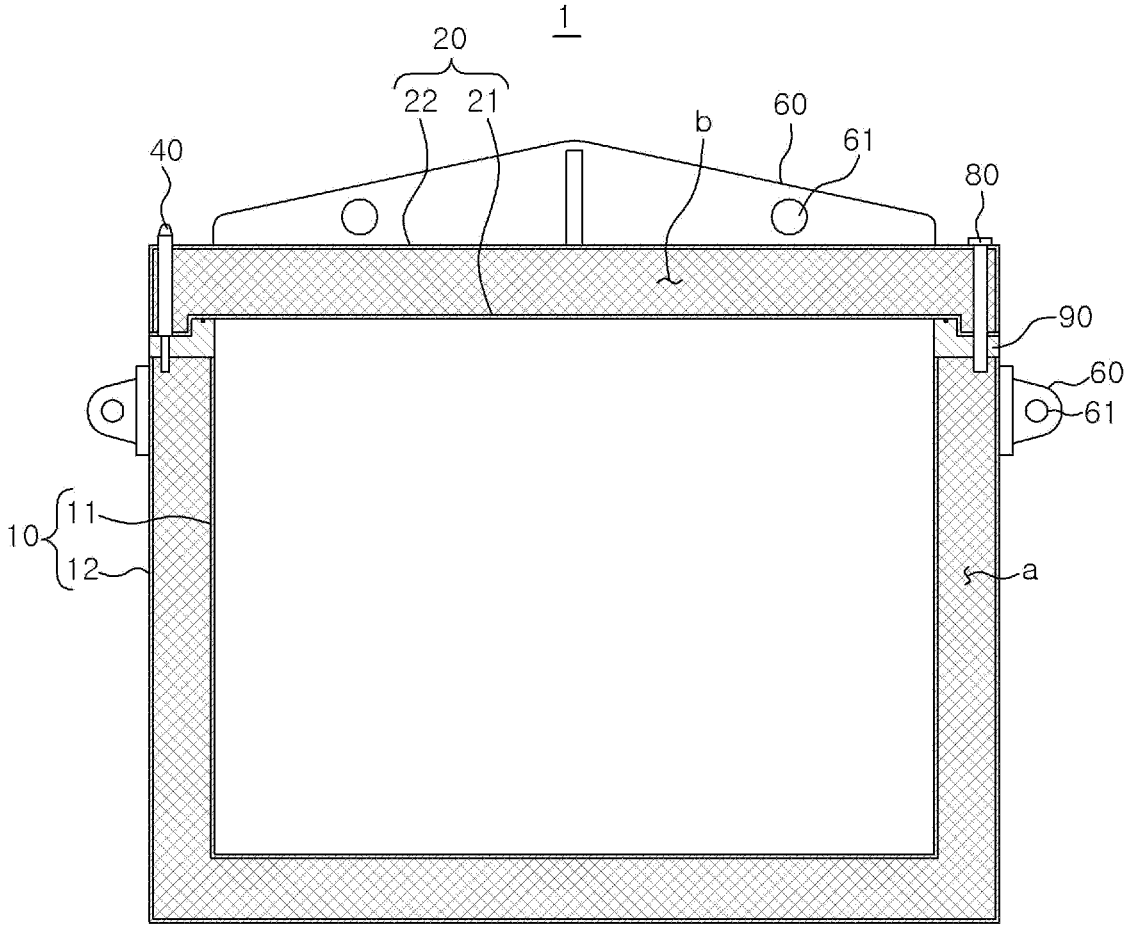
FIG. 11 is a cross sectional view showing a radioactive waste container according to another embodiment of the present invention.
Figure 12:
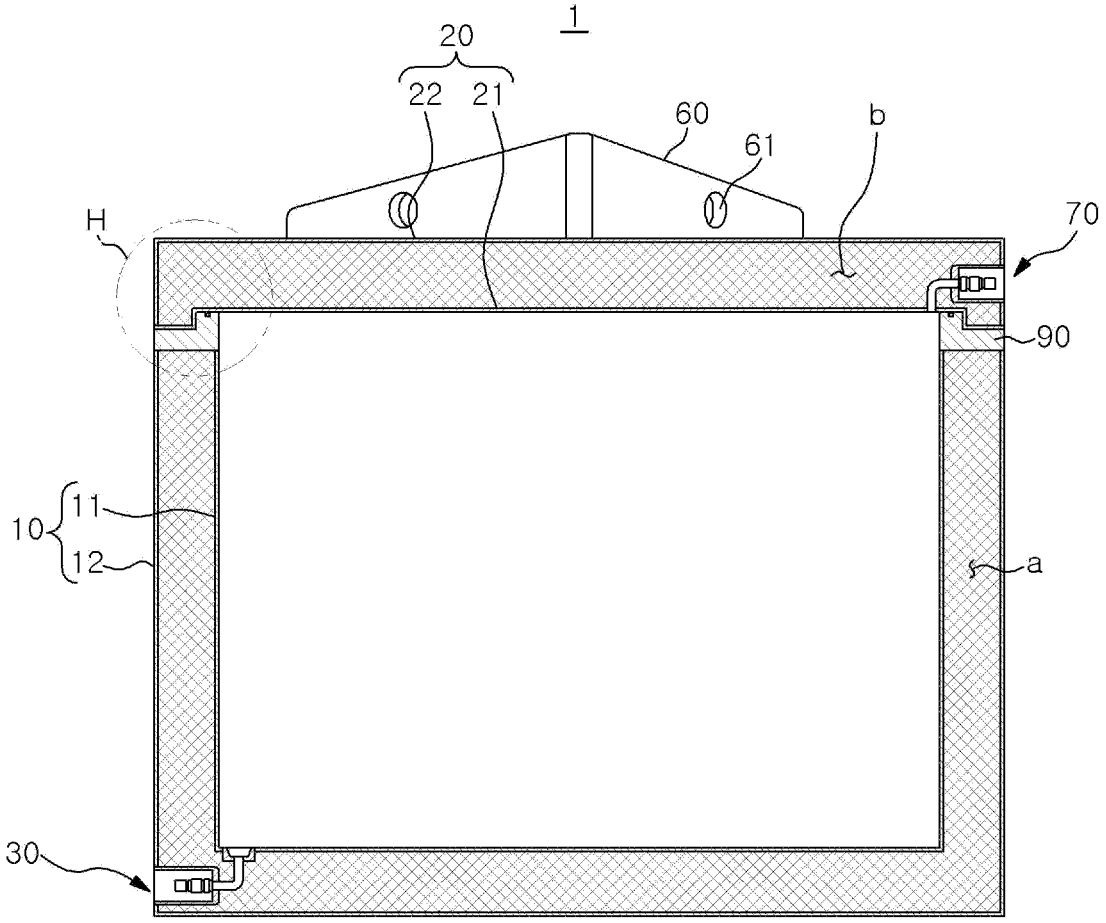
FIG. 12 is a cross sectional view showing a radioactive waste container according to another embodiment of the present invention.
Figure 13:
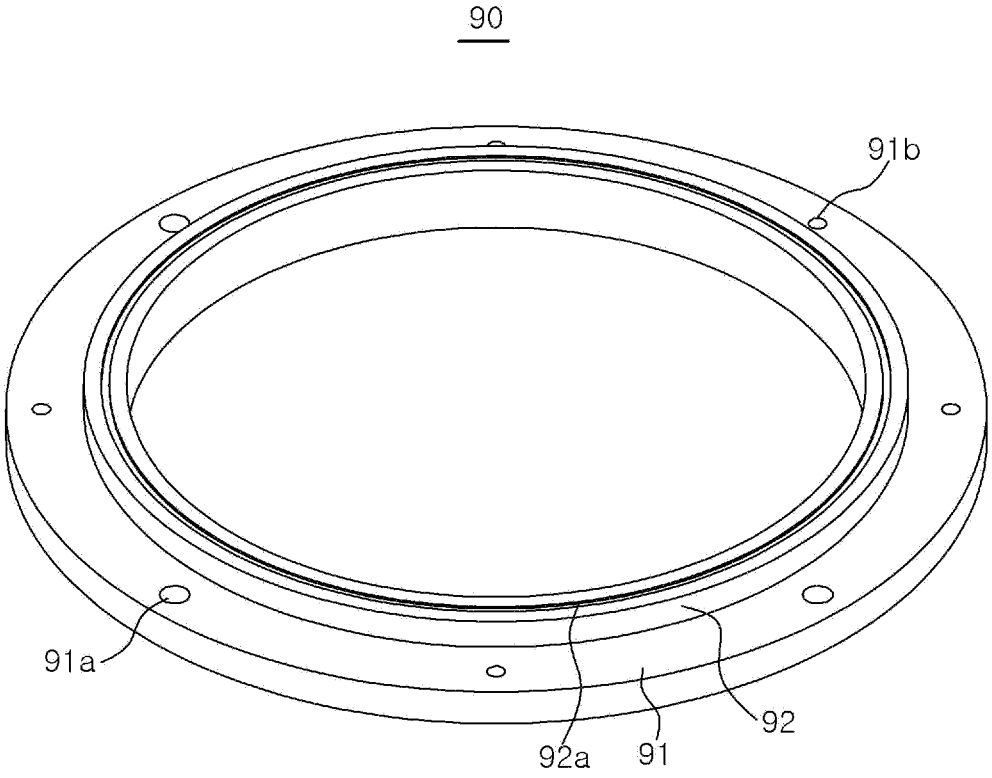
FIG. 13 is a perspective view showing an intermediate plate of the radioactive waste container shown in FIG. 11.
Figure 14:
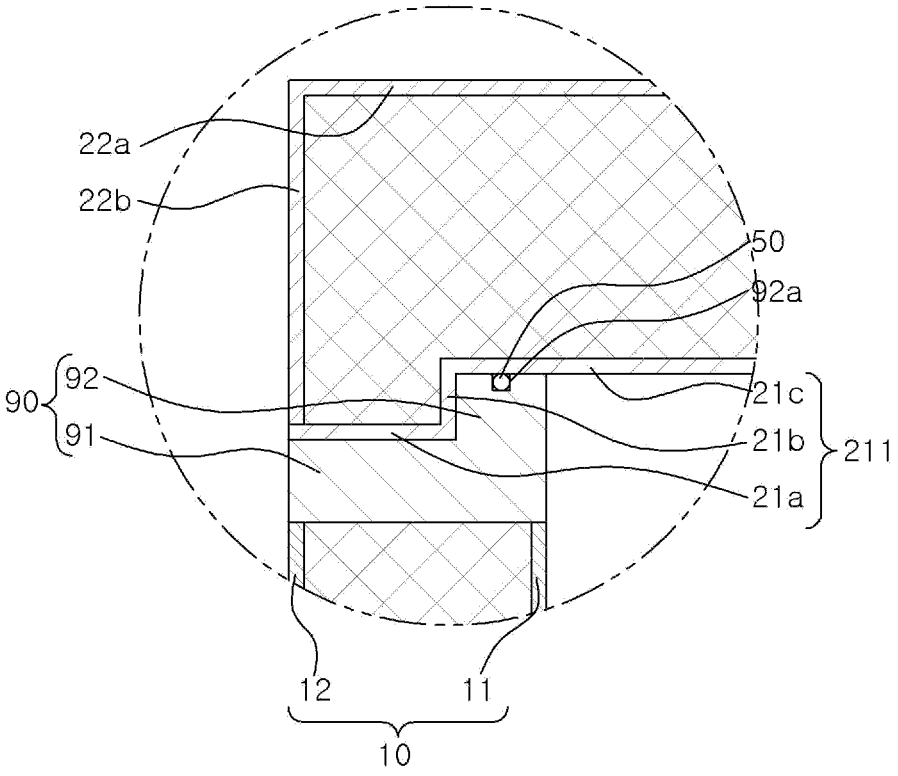
FIG. 14 is an enlarged view showing portion H of FIG. 12.

Hereinafter, a radioactive waste container 1 according to another embodiment of the present invention will be described with reference to FIGS. 11 to 14. FIGS. 11 and 12 are cross sectional views showing the radioactive waste container according to another embodiment of the present invention which correspond to FIGS. 3 and 4, respectively. FIG. 13 is a perspective view showing an intermediate plate of the radioactive waste container shown in FIG. 11. FIG. 14 is an enlarged view showing a portion H shown in FIG. 12.

Referring to FIGS. 11 to 14, the radioactive waste container 1 according to another embodiment of the present invention may include a container body 10, a cover 20, a water drain unit 30, guide pins 40, a gasket 50, lifting lugs 60, an air supply unit 70, bolts 80, and an intermediate plate 90. The configuration of the radioactive waste container 1 shown in FIG. 11 is the same as that of the radioactive waste container 1 described with reference to FIGS. 1 to 10, except the container body 10 and the intermediate plate 90. In the following description, the difference, i.e., the container body 10 and the intermediate plate 90, will be mainly described. Further, like reference numerals will be used for like parts and redundant description thereof will be omitted.

As shown in FIG. 11, the outer body 12 may have a diameter greater than that of the inner body 11 to surround the inner body 11. Further, the outer body 12 may be formed in a cylindrical shape with an open top. The outer body 12 may be made of substantially the same material as that of the inner body 11. For example, the outer body 12 may be made of stainless steel.

The intermediate plate 90 can be provided on an upper portion of the inner body 11 and an upper portion of the outer body 12. For example, the intermediate plate 90 may be a ring-shaped plate with a central opening. The inner body 11, the outer body 12 and the intermediate plate 90 can be fastened by, e.g., welding. A lead shielding material can be inserted into in a first hollow portion a.

The intermediate plate 90 may include a first contact portion 91 covering the first hollow portion a and a second contact portion 92 that is extended from the radially inner side of the container body 10, compared to the first contact portion 91, toward the cover 20 and brought into contact with the cover 20. In other words, when the bottom plate 21 of the cover 20 has a first engaging portion 21*a*, a second engaging portion 21*b*, and a cover portion 21*c* as shown in FIG. 10, the first contact portion 91 is brought into contact with the first engaging portion 21*a* and the second contact portion 92 is brought into contact with a part of the cover portion 21*c* in a state where the cover 20 is fastened to the container body 10. Accordingly, a higher shielding effect can be obtained as in the case of the irregularities 101 on the upper surface of the container body 10 and the accommodating portion on the lower surface of the bottom plate 21 of the cover 20 in the embodiment described with respect to FIGS. 1 to 10.

Guide pin insertion holes 91*a* into which the guide pin 40 can be inserted and bolt insertion holes 91*b* into which the bolts 80 can be inserted may be formed on one surface of the first contact portion 91. A gasket insertion groove 92*a* into which the gasket 50 can be inserted may be recessed on one surface of the second contact portion 92.

In the radioactive waste container 1 configured as described above, the container body 10 and the cover 20 are primarily fixed by the guide pins 40 under water and, then, the container body 10 and the cover 20 are firmly sealed and fixed by the bolts 80. Therefore, the radiation generated from the radioactive waste stored in the container body 10 can be effectively shielded.

Further, in accordance with the embodiments of the present invention, the radiation generated from the radioactive waste stored in the container body 10 can be prevented from leaking to the outside of the container body 10 due to the presence of one or more irregularities 101 formed on the upper surface of the container body 10 and the accommodating portions 211 to be coupled to the irregularities 101, the accommodating portions 211 being formed on the lower surface of the bottom plate 21 which will be in contact with the upper surface of the container body 10.

Further, in accordance with the embodiments of the present invention, it is possible to selectively drain water flown into the container body 10 together with the radioactive waste during the process of storing the radioactive waste generated in the radioactive waste generation site, e.g., under water, in the container body 10 under water.

Further, in accordance with the embodiments of the present invention, it is possible to safely lift the radioactive waste container 1 from water upon completion of the storage of the radioactive waste under water and easily transport the radioactive waste container 1 to the radioactive waste disposal site.

Although the embodiments of the present invention have been described, they are merely examples. The present invention is not limited thereto and should be interpreted to have the widest scope according to the basic idea disclosed in this specification. Those skilled in the art may implement patterns of shapes that are not indicated by combining and replacing the disclosed embodiments within a range, not departing from the scope of the present invention. In addition, those skilled in the art may easily change and modify the disclosed embodiments based on this specification, and it will be apparent that such changes or modifications are within the scope of the present invention.

DESCRIPTION OF REFERENCE NUMERALS

1: radioactive waste container
10: container body
11: inner body
101: irregularities
111: main surface portion
112: extended portion
112*a*: gasket insertion groove
113: inner body side coupling portion
12: outer body
12*a*: first recessed groove
121: cover portion
122: outer body side coupling portion
122*a*: guide pin insertion hole
122*b*: bolt insertion hole
20: cover
21: bottom plate
211: accommodating portions
21*a*: first engaging portion
21*b*: second engaging portion
21*c*: cover portion
22: top plate
22*a*: facing portion
22*b*: bottom plate side coupling portion
221*a*: guide pin insertion hole
221*b*: bolt insertion hole
22*c*: second recessed groove
30: water drain unit
31: water drain cup
32: water drain pipe
33: water drain coupler
40: guide pin
50: gasket
60: lifting lug
61: engaging hole
70: air supply unit
71: air supply pipe
71*a*: extended portion
71*b*: bent portion
72: air supply coupler
80: bolt
90: intermediate plate
91: first contact portion
1*a*: guide pin insertion hole
91*b*: bolt insertion hole
92: second contact portion
92*a*: gasket insertion groove

What is claimed is:

1. A radioactive waste container to store and transport a radioactive waste, comprising:

a container body having a radioactive waste storage space for storing the radioactive waste, the container including:

an inner body; and an outer body surrounding the inne body, the inner body and the outer body defining a first hollow portion therebetween;

a cover fastened to the container body, wherein the cover includes a bottom plate structured to be in contact with an upper surface of the container body;

a top plate above the bottom plate, the top plate and the bottom plate defining a second hollow portion therebetween;

a water drain unit provided at the container body without protruding to an outside of the container body and configured to selectively drain water from the radioactive waste storage space, the water drain unit including:

a water drain cup in the inner body;

a water drain pipe extending toward a bottom surface of the outer body when connected to the water drain cup and bent in a direction toward a radially outer side of the container body; and a water drain coupler at an end portion of the water drain pipe that is positioned at the outer body, the water drain cup recessed from a bottom surface of the inner body toward an opening of the water drain pipe; and an air supply unit provided at the cover without protruding to an outside of the cover and configured to selectively supply air into the container body, the air supply unit including:

an air supply pipe extending towar the top plate, connected to the bottom plate, and bent in a direction toward a radially outer side of the cover; and an air supply coupler at an end portion of the air supply pipe that is positioned at an outer side of the top plate, and wherein the air supply coupler is provided inside a second recessed groove in the top plate that is recessed from an outer surface of the top plate in a direction toward a radially inner side of the cover.

2. The radioactive waste container of claim 1, wherein an outer side end portion of the water drain pipe is inside the container body, and the water drain pipe is in communication with the radioactive waste storage space.

3. The radioactive waste container of claim 1, wherein two or more guide pin insertion holes are formed on the container body and the cover along a circumferential direction of the container body and the cover, and wherein an initial position of the cover with respect to the container body is determined by guide pins inserted into the guide pin insertion holes before the container body and the cover are fastened.

4. The radioactive waste container of claim 3, wherein two or more bolt insertion holes are formed on the container body and the cover along the circumferential direction of the container body and the cover, and wherein the container body and the cover are fastened by bolts inserted into the bolt insertion holes.

5. The radioactive waste container of claim 4, further comprising a gasket between the container body and the cover.

6. The radioactive waste container of claim 5, wherein a gasket insertion groove into which the gasket is inserted is formed on an upper surface of the container body.

7. The radioactive waste container of claim 6, wherein the gasket insertion groove is disposed at a radially inner side of the container body, compared to the guide pin insertion holes and the bolt insertion holes on the upper surface of the container body.

8. The radioactive waste container of claim 1, further including a radiation shielding material in the first hollow portion.

9. The radioactive waste container of claim 1, wherein a radiation shielding material is provided in the second hollow portion.

10. The radioactive waste container of claim 1, wherein one or more irregularities are formed on the upper surface of the container body, and accommodating portions, configured to be coupled to the irregularities of the container body, are formed on a lower surface of the bottom plate, which is configured to be in contact with the upper surface of the container body.

11. The radioactive waste container of claim 10, wherein the irregularities exhibit a multi-step shape, and the accommodating portions exhibit a multi-step shape capable of being coupled to the irregularities.

12. The radioactive waste container of claim 1, wherein at least one of the container body and the cover includes a lifting lug.

13. The radioactive waste container of claim 1, wherein the water drain coupler is inside a first recessed groove in the outer body that is recessed from an outer surface of the outer body in a direction toward a radially inner side of the container body.

14. The radioactive waste container of claim 1, further comprising: an intermediate plate between the container body and the cover.

* * * * *